US009332830B1

(12) United States Patent
Thompson

(10) Patent No.: US 9,332,830 B1
(45) Date of Patent: May 10, 2016

(54) TOOTHPASTE DISPENSING TOOTHBRUSH AND MOUTHWASH DISPENSER

(71) Applicant: Sharron E. Thompson, Orlando, FL (US)

(72) Inventor: Sharron E. Thompson, Orlando, FL (US)

( * ) Notice: Subject to any disclaimer, the term of this patent is extended or adjusted under 35 U.S.C. 154(b) by 0 days.

(21) Appl. No.: 14/468,429

(22) Filed: Aug. 26, 2014

(51) Int. Cl.
*A46B 11/00* (2006.01)

(52) U.S. Cl.
CPC ..... *A46B 11/0055* (2013.01); *A46B 11/0072* (2013.01)

(58) Field of Classification Search
CPC ..... A46B 11/0037; A46B 11/0055
USPC ..... 401/150, 171, 176
See application file for complete search history.

(56) References Cited

U.S. PATENT DOCUMENTS

| | | | | |
|---|---|---|---|---|
| 1,726,197 | A * | 8/1929 | Soukup | 401/175 |
| 2,308,078 | A * | 1/1943 | Hendrickson | 222/387 |
| 2,631,762 | A * | 3/1953 | Perwas | 222/402 |
| 4,467,822 | A | 8/1984 | Blackwell | |
| 5,039,244 | A * | 8/1991 | Cheng | 401/176 |
| 5,842,487 | A | 12/1998 | Ledet | |
| 6,056,466 | A * | 5/2000 | Johnson et al. | 401/188 R |
| D426,708 | S | 6/2000 | Francis | |
| 6,669,390 | B1 | 12/2003 | Porter | |
| 6,685,375 | B1 * | 2/2004 | Crocker | 401/176 |
| 7,112,003 | B2 | 9/2006 | Frison | |
| 7,311,456 | B1 * | 12/2007 | Neal et al. | 401/47 |
| 2002/0114658 | A1 * | 8/2002 | Allen et al. | 401/176 |
| 2007/0183838 | A1 * | 8/2007 | Umar | 401/269 |
| 2007/0209676 | A1 * | 9/2007 | McCabe et al. | 132/311 |
| 2009/0297253 | A1 * | 12/2009 | Yuu | 401/277 |
| 2011/0176857 | A1 * | 7/2011 | Rodriguez | 401/282 |
| 2012/0160261 | A1 | 6/2012 | Harden | |

* cited by examiner

*Primary Examiner* — Jennifer C Chiang
*Assistant Examiner* — Joshua Wiljanen
(74) *Attorney, Agent, or Firm* — Kyle A. Fletcher, Esq.

(57) ABSTRACT

The toothbrush assembly includes a housing that may be gripped by a user. A toothpaste reservoir is positioned within an interior of the housing. the toothpaste reservoir contains a toothpaste. A plunger is movably coupled to the toothpaste reservoir. The plunger urges the toothpaste outwardly from the toothpaste reservoir. A toothbrush is coupled to the housing. A tube is coupled between the toothpaste reservoir and the toothbrush. The toothpaste is dispensed from the toothbrush.

18 Claims, 2 Drawing Sheets

TOOTHPASTE DISPENSING TOOTHBRUSH AND MOUTHWASH DISPENSER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of toothpaste dispensers, more specifically, toothpaste dispensing toothbrushes and mouthwash dispensers.

SUMMARY OF THE INVENTION

An embodiment of the disclosure meets the needs presented above by generally comprising a housing that may be gripped by a user. A toothpaste reservoir is positioned within an interior of the housing. The toothpaste reservoir contains a toothpaste. A plunger is movably coupled to the toothpaste reservoir. The plunger urges the toothpaste outwardly from the toothpaste reservoir. A toothbrush is coupled to the housing. A tube is coupled between the toothpaste reservoir and the toothbrush. The toothpaste is dispensed from the toothbrush.

An object of the invention is to provide a device that is toothpaste dispensing toothbrush and mouthwash dispenser.

These together with additional objects, features and advantages of the toothpaste dispensing toothbrush and mouthwash dispenser will be readily apparent to those of ordinary skill in the art upon reading the following detailed description of presently preferred, but nonetheless illustrative, embodiments of the toothpaste dispensing toothbrush and mouthwash dispenser when taken in conjunction with the accompanying drawings.

In this respect, before explaining the current embodiments of the toothpaste dispensing toothbrush and mouthwash dispenser in detail, it is to be understood that the toothpaste dispensing toothbrush and mouthwash dispenser is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toothpaste dispensing toothbrush and mouthwash dispenser.

It is therefore important that the claims be regarded as including such equivalent construction insofar as they do not depart from the spirit and scope of the toothpaste dispensing toothbrush and mouthwash dispenser. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
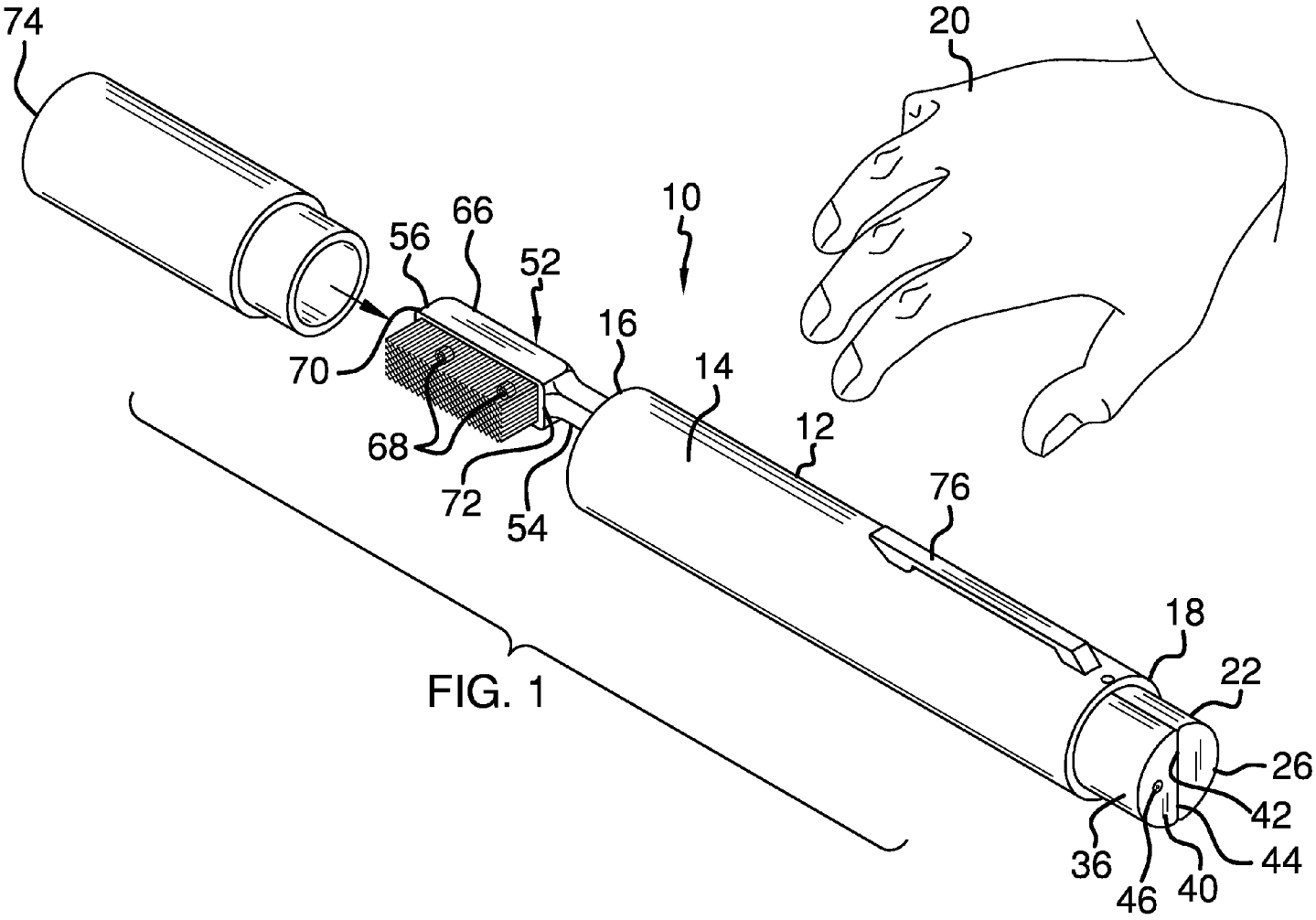
FIG. 1 is a perspective view of a toothbrush assembly according to an embodiment of the disclosure.
Figure 2:
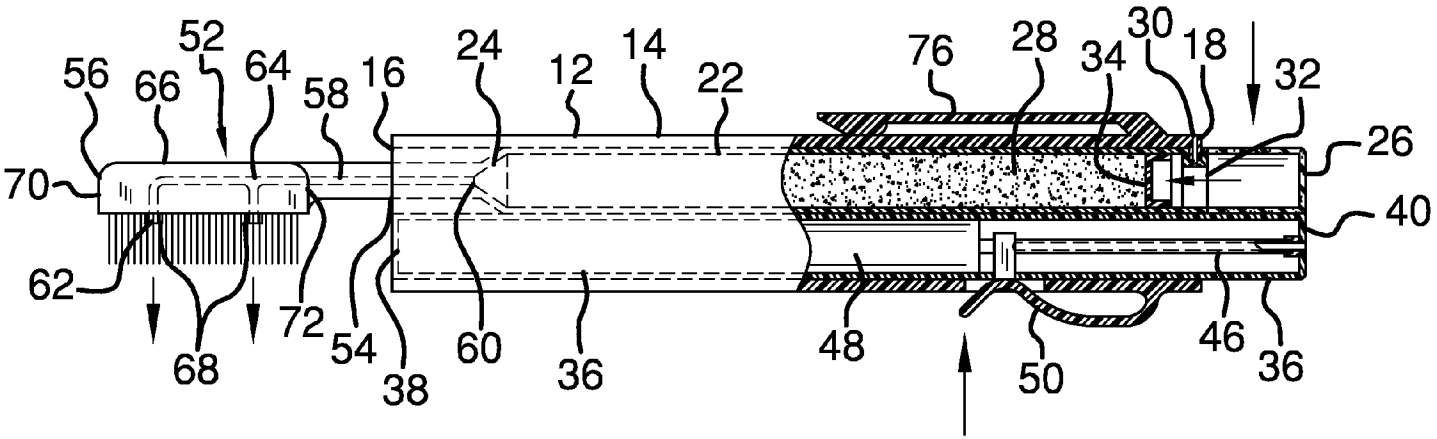
FIG. 2 is a left side cutaway view of an embodiment of the disclosure.
Figure 3:
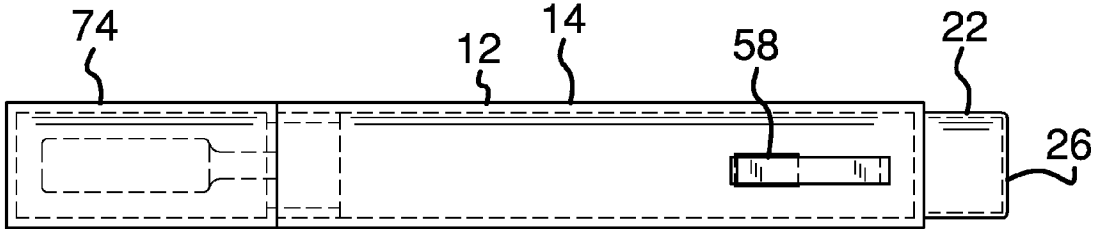
FIG. 3 is a top view of an embodiment of the disclosure.
Figure 4:
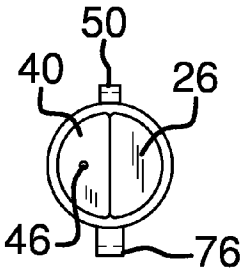
FIG. 4 is a back view of an embodiment of the disclosure.

As best illustrated in FIGS. 1 through 4, the toothbrush assembly 10 generally comprises a housing 12. The housing 12 has an exterior wall 14 extending between each of a first end 16 and a second end 18 of the housing 12. The housing 12 is elongated and is substantially hollow. Additionally, the second end 18 of the housing 12 is open. The housing 12 may be gripped by a user 20.

A toothpaste reservoir 22 is provided. The toothpaste reservoir 22 has a front end 24 and a back end 26. Additionally, the toothpaste reservoir 22 is elongated.

The toothpaste reservoir 22 is positioned within an interior of the housing 12. The back end 26 of the toothpaste reservoir 22 extends outwardly from the second end 18 of the housing 12. The toothpaste reservoir 22 contains a toothpaste 28. The toothpaste 28 may be of any conventional design.

A plunger 30 is provided. The plunger 30 has an engaged end 32 and a plunging end 34. The engaged end 32 of the plunger 30 is coupled to the back end 26 of the toothpaste reservoir 22. The plunging end 34 of the plunger 30 is positioned within an interior of the toothpaste reservoir 22.

The back end 26 of the toothpaste reservoir 22 is depressible inwardly into the toothpaste reservoir 22. The plunger 30 is urged forwardly in the toothpaste reservoir 22. Moreover, the plunger 30 urges the toothpaste 28 outwardly from the toothpaste reservoir 22.

A mouthwash reservoir 36 is provided. The mouthwash reservoir 36 has a forward end 38 and a rearward end 40. The mouthwash reservoir 36 is elongated. Additionally, the mouthwash reservoir 36 is positioned within an interior of the housing 12. The rearward end 40 of the mouthwash reservoir 36 extends outwardly from the second end 18 of the housing 12.

A first lateral side 42 of the toothpaste reservoir 22 is flattened. A second lateral side 44 of the mouthwash reservoir 36 is flattened. Each of the toothpaste 22 and mouthwash 36 reservoirs has a quonset shape. The first lateral side 42 of the toothpaste reservoir 22 abuts the second lateral side 44 of the mouthwash reservoir 36.

A spray nozzle 46 extends through the rearward end 40 of the mouthwash reservoir 36. The mouthwash reservoir 36 contains a mouthwash 48. The mouthwash 48 may be a pressurized liquid mouthwash of any conventional design. An actuator 50 is coupled to the exterior wall 14 of the housing 12. The actuator 50 engages the spray nozzle 46. The spray nozzle 46 sprays the mouthwash 48 when the actuator 50 is actuated.

A toothbrush 52 is provided. The toothbrush 52 has a coupled end 54 and a free end 56. The coupled end 54 of the toothbrush 52 is coupled to the first end 16 of the housing 12. The toothbrush 52 may be a toothbrush of any conventional design.

A tube 58 has a primary end 60 and a secondary end 62. The tube 58 extends through the toothbrush 52. Moreover, the primary end 60 of the tube 58 is fluidly coupled to the front end 24 of the toothpaste reservoir 22. The tube 58 has a Y 64 in a head 66 of the toothbrush 52. The Y 64 defines a pair of secondary ends 68 of the tube 58.

Each of the pair of secondary ends 68 of the tube 58 is exposed on the head 66 of the toothbrush 52. Additionally, each of the pair of secondary ends 68 of the toothbrush 52 are positioned proximate associated ones of a front end 70 and a back end 72 of the head 66 of the toothbrush 52. The toothpaste 28 is dispensed from the pair of secondary ends 68 of the tube 58 when the back end 26 of the toothpaste reservoir 22 is depressed.

A cap 74 is provided. The cap 74 is removably coupled to the second end 18 of the housing 12. Additionally, the cap 74 covers the toothbrush 52. A clip 76 is coupled to the exterior wall 14 of the housing 12. The clip 76 may engage the user 20.

In use, the back end 26 of the toothpaste reservoir 22 is depressed to dispense the toothpaste 28 onto the head 66 of the toothbrush 52. The toothbrush 56 is employed in the convention of oral hygiene. The user 20 actuates the actuator 50 to spray the mouthwash 48.

With respect to the above description, it is to be realized that the optimum dimensional relationship for the various components of the toothbrush assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the toothbrush assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A toothbrush assembly configured to store and dispense a toothpaste, said assembly comprising:

a housing configured to be gripped by a user;

a toothpaste reservoir positioned within an interior of said housing, said toothpaste reservoir containing the toothpaste;

a plunger movably coupled to said toothpaste reservoir wherein said plunger urges the toothpaste outwardly from said toothpaste reservoir;

a toothbrush coupled to said housing;

a tube coupled between said toothpaste reservoir and said toothbrush wherein the toothpaste is dispensed from the toothbrush;

wherein said housing has an exterior wall extending between each of a first end and a second end of said housing;

a mouthwash reservoir is provided with a forward end and a rearward end; wherein the mouthwash reservoir is positioned within the interior of the housing;

wherein the rearward end of the mouthwash reservoir extends outwardly from the second end of the housing;

wherein each of the toothpaste and mouthwash reservoirs has a quonset shape;

wherein a first lateral side of the toothpaste reservoir abuts the second lateral side of the mouthwash reservoir;

wherein a spray nozzle extends through the rearward end of the mouthwash reservoir;

wherein the mouthwash reservoir contains a mouthwash;

wherein an actuator is coupled to the exterior wall of the housing;

wherein the actuator engages the spray nozzle;

wherein the spray nozzle sprays the mouthwash when the actuator is actuated.

2. The assembly according to claim 1, said housing being elongated.

3. The assembly according to claim 2, said housing being substantially hollow.

4. The assembly according to claim 3, said second end of said housing being open.

5. The assembly according to claim 1, said toothpaste reservoir having a front end and a back end, said toothpaste reservoir being elongated.

6. The assembly according to claim 5, said toothpaste reservoir being positioned within an interior of said housing such that said back end of said toothpaste reservoir extends outwardly from a second end of said housing.

7. The assembly according to claim 1, said plunger having an engaged end and a plunging end.

8. The assembly according to claim 7, said engaged end of said plunger being coupled to a back end of said toothpaste reservoir such that said plunging end of said plunger is positioned within an interior of said toothpaste reservoir.

9. The assembly according to claim 8, said back end of said toothpaste reservoir being depressible inwardly into said toothpaste reservoir such that said plunger is urged forwardly in said toothpaste reservoir.

10. The assembly according to claim 1, said toothbrush having a coupled end and a free end.

11. The assembly according to claim 10, said coupled end of said toothbrush being coupled to a first end of said housing.

12. The assembly according to claim 1, said tube having a primary end and a secondary end.

13. The assembly according to claim 12, said tube extending through said toothbrush such that said primary end of said tube is fluidly coupled to a front end of said toothpaste reservoir and said secondary end of said tube is exposed on a head of said toothbrush.

14. The assembly according to claim 13, the toothpaste is dispensed from said secondary end of said tube when a back end of said toothpaste reservoir is depressed.

15. A toothbrush assembly configured to store and dispense a toothpaste, said assembly comprising:

a housing having an exterior wall extending between each of a first end and a second end of said housing, said housing being configured to be gripped by a user;

a toothpaste reservoir positioned within an interior of said housing, said toothpaste reservoir containing the toothpaste;

a plunger movably coupled to said toothpaste reservoir wherein said plunger urges the toothpaste outwardly from said toothpaste reservoir;

a toothbrush coupled to said housing;

a tube coupled between said toothpaste reservoir and said toothbrush wherein the toothpaste is dispensed from the toothbrush;

said housing being elongated; said housing being substantially hollow; said second end of said housing being open;

a mouthwash reservoir is provided with a forward end and a rearward end; wherein the mouthwash reservoir is positioned within the interior of the housing;

wherein the rearward end of the mouthwash reservoir extends outwardly from the second end of the housing;

wherein each of the toothpaste and mouthwash reservoirs has a quonset shape;

wherein a first lateral side of the toothpaste reservoir abuts the second lateral side of the mouthwash reservoir;

wherein a spray nozzle extends through the rearward end of the mouthwash reservoir; wherein the mouthwash reservoir contains a mouthwash;

wherein an actuator is coupled to the exterior wall of the housing;

wherein the actuator engages the spray nozzle;

wherein the spray nozzle sprays the mouthwash when the actuator is actuated.

16. The assembly according to claim 15, said toothpaste reservoir having a front end and a back end; said toothpaste reservoir being elongated; said toothpaste reservoir being positioned within an interior of said housing such that said back end of said toothpaste reservoir extends outwardly from said second end of said housing; said plunger having an engaged end and a plunging end; said engaged end of said plunger being coupled to a back end of said toothpaste reservoir such that said plunging end of said plunger is positioned within an interior of said toothpaste reservoir; said back end of said toothpaste reservoir being depressible inwardly into said toothpaste reservoir such that said plunger is urged forwardly in said toothpaste reservoir.

17. The assembly according to claim 15, said toothbrush having a coupled end and a free end; said coupled end of said toothbrush being coupled to said first end of said housing.

18. The assembly according to claim 15, said tube having a primary end and a secondary end; said tube extending through said toothbrush such that said primary end of said tube is fluidly coupled to a front end of said toothpaste reservoir and said secondary end of said tube is exposed on a head of said toothbrush; wherein the toothpaste is dispensed from said secondary end of said tube when a back end of said toothpaste reservoir is depressed.

* * * * *